United States Patent [19]

Kelly et al.

[11] Patent Number: 4,468,445

[45] Date of Patent: Aug. 28, 1984

[54] ELECTROPHOTOGRAPHIC MIXTURE CONTAINING TONER PARTICLES AND COATED CARRIER PARTICLES

[76] Inventors: Paul P. Kelly, 39134 Ebbets, Newark, Calif. 94560; Trudy A. Bochantin Connor, 65 Adam Way, Atherton, Calif. 94025

[21] Appl. No.: 462,142

[22] Filed: Jan. 31, 1983

[51] Int. Cl.[3] ..... G03G 9/00

[52] U.S. Cl. ..... 430/107; 430/108; 430/111

[58] Field of Search .....430/904, 107, 110, 111

[56] References Cited

U.S. PATENT DOCUMENTS 3,900,588 8/1975 Fisher ..... 430/107

3,965,021 6/1976 Clemens et al. ..... 430/904

*Primary Examiner*—John E. Kittle

*Assistant Examiner*—John L. Goodrow

*Attorney, Agent, or Firm*—Flehr, Hohbach, Test, Albritton & Herbert

[57] ABSTRACT

Novel electrostatic developer compositions are provided comprising finely divided toner particles coated on carrier particles wherein the carrier particles comprise a solid core of an iron oxide and a coating of a thermoplastic consisting of a hydroxy ether copolymer of epichlorohydrin and 2,2-bis(p-hydroxy phenyl) propane.

10 Claims, No Drawings

ELECTROPHOTOGRAPHIC MIXTURE CONTAINING TONER PARTICLES AND COATED CARRIER PARTICLES

The present invention is directed to novel developing materials for use in electrographic imaging processes.

In the electrophotographic art, the formation and development of images on photoconductive materials by electrostatic means may be accomplished by placing a uniform electrostatic charge on the photoconductive layer, exposing the layer to light and shadow image to dissipate the charge on the areas of the layer exposed to the light, and developing the resulting light and electrostatic image by depositing on the image a finely divided electroscopic material referred to in the art as "toner". The toner is normally attracted to those areas of the layer which retain the charge, thereby forming a toner image corresponding to the latent electrostatic image. This powder image may then be transferred to a support surface such as paper and permanently affixed by heat treatment. Other electrophotographic processes include forming the latent image by directly charging the photoconductive layer in an imaging configuration. The powder image may be fixed to the photoconductive layer if elimination of the powder image transfer step is desired. Other suitable means such as solvent or overcoating treatment may be substituted for the heat fixing step.

The electroscopic toner material which may be used in the above-described process is usually provided in the developer composition in which the toner particles are electrostatically coated on carrier particles. See, for example, U.S. Pat. No. 4,331,756. The composition of the carrier particles is chosen so as to triboelectrically charge the toner particles to the desired polarity so that as the developer mixture contacts the image bearing surface, the toner particles are electrostatically deposited and secured to the charged portion of the latent image. The toner particles are not deposited on the uncharged portion of the image and any toner particles which are accidentally deposited on these uncharged portions may be removed by contacting with a carrier surface over the image, which removes the accidentally deposited toner particles from the uncharged portions due to the greater electrostatic attraction between toner and carrier and between toner and uncharged image.

The developer material may be contacted with the image surface by cascading developer particles over the image surface or by using magnetic carrier particles whereby the developer composition may be aligned on a surface in a brush-like configuration by a magnet and the brush-like surface may be engaged with the image bearing surface.

In common commercial processes, the developing processes carried out by automatic machines wherein the developing composition comprising carrier particles and toner particles are constantly circulated and returned to a sump for recycling through the developing system. This process is repeated for each copy produced in the machine and is ordinarily repeated thousands of times during the usable life of the developer. A great deal of mechanical agitation causes degradation of both the toner and carrier particles and such degradation is manifested by print deletion and poor print quality on the copies. Also, the triboelectric and flow characteristics of many carriers are adversely effected when the relative humidity is high. Furthermore, many carrier materials, which are normally core particles having a particular coating are difficult to manufacture since the application of the appropriate coating to the carrier surface of the core may tend to form thin filaments rather than a smooth continuous coating. Developer materials must flow freely to facilitate accurate metering and even distribution during the developer recycling phases of electrophotographic process and the presence of filaments and carriers having rough outer surfaces is unsuitable because such developer materials tend to cake, bridge and agglomorate. Some carrier coating materials have acceptable triboelectric and coating properties but are unacceptable on a commercial scale because they may not be economically mass produced. For example, quality control for the triboelectric value of some resonant blends are difficult to maintain because of a slight deviation in component percentages may cause the triboelectric value of the resulting developer to change drastically. Therefore, it is evident that there is a continuing need for improved developer materials for the electrophotographic processes.

It is therefore an object of the present invention to provide novel developer materials which provide high quality images after extensive use within an electrophotographic copying machine.

It is also an object of the present invention to provide developer materials which show stable Q/M values when used in electrophotographic machines.

The above objects and other objects may be accomplished by providing a novel electrostatic developer mixture comprising finely divided toner particles coated on carrier particles wherein the carrier particles comprise a solid core of an iron oxide and a coating comprising a thermoplastic polymer of polyhydroxy ether of bisphenol A and epichlorohydrin. The toner used in conjunction with these carrier particles may be a mixture of about 91% by weight of bisphenol A/fumarate polyester and about 9% carbon black, optionally containing a minor amount of additives. Another toner which may be used in accordance with the present invention is a blend of about 8.8% by weight bisphenol A/fumarate polyester, about 80% bisphenol A/epichlorohydrin epoxy thermoplastic, about 11% carbon black, optionally containing a minor amount of additives.

The developer composition may contain certain additives to the toner composition. These additives are preferably conventional lubricants and cleaning agents such as metal stearates and silica.

The solid core of the carrier particles according to the present invention comprises an iron oxide, preferably having a particulate mean diameter of from about 30 to 1000 microns. Preferably the carrier core comprises ferrite particles such that greater than 80% of the particles have a mean diameter of about 100 microns. The thermoplastic copolymer coating on said carrier particles may comprise about 0.1 to 1% by weight of the carrier. Preferably the copolymer coating is about 0.5% by weight of the carrier. The copolymer material may be a copolymer of epichlorohydrin and 2,2-bis-(p-hydroxy phenyl) propane, commonly known as bisphenol A, or derivative thereof. A preferred class of derivatives are the hydroxyalkyl ethers, particularly the hydroxypropyl ether, of the copolymer. The preferred thermoplastic copolymer is a Bakelite® phenoxy resin which is available from Union Carbide Corporation with a range of molecular weight from 20,000 to 35,000.

A particularly preferred copolymer is a Bakelite® (Trademark of Union Carbide) phenoxy resin PKHJ which has a specific gravity between about 1.17 to 1.19. The viscosity of Bakelite® phenoxy resin PKHJ is in the range of 5,500 to 7,700 centipoises at 25° C.

The toner according to the present invention may comprise from about 1.5% to about 4% by weight of the developer composition. The toners according to the present invention may be designated as E' toner or a polyester/epoxy toner, P-5-1. When using the E' toner it is preferred that the developer composition contain about 3% toner by weight of the composition. When using P-5-1 toner it is preferred that the developer composition contain about 2% by weight of the developer mixture. The E' toner consists of a polyester of hydroxyisopropyl ether of bisphenol A (2,2-bis-(4-hydroxyisopropoxyphenyl)propane) and fumaric acid commercially available from ICI, America (91% by wt.) and 9% carbon black. Various additives may be added as described hereinabove, preferably by admixing the bisphenol A/fumarate polyester/carbon black mixture with 1% by weight silica and 0.75% zinc stearate. The P-5-1 toner comprises a blend of the polyester of the hydroxyisopropyl ether of bisphenol A/fumarate (8.8% by weight), bisphenol A/epichlorohydrin epoxy thermoplastic commercially available from Shell Chemical Co. (about 80% by weight, preferably 79.8%); and about 11%, preferably 11.4%, by weight carbon black. Various additives may be added by taking this mixture and admixing 1% silica and 0.7% zinc stearate therewith.

The carrier particles may be coated by applying to a core the thermoplastic copolymer by any suitable means to produce carrier particles. For example, the coating may be applied by dipping, spraying, or tumbling the cores with a coating solution in a barrel or spray coating in a fluidized bed. The fluidized bed process permits the production of a uniform coating on the core particles. Other known methods for coating carrier particles may be utilized as described in, for example, U.S. Pat. Nos. 2,648,409, 2,799,241, 3,253,944, 3,196,827, or 3,241,520.

A preferred method for coating the carrier cores comprises the steps of suspending the core particles in a fluidized bed and circulating in an upwardly flowing stream of heated gas the particles in a manner such that the particles move upwardly and are sprayed by the coating material in a first spraying zone. Then, in a second zone, the particles settle through the gas stream in a zone of lower air velocity and the liquid which is a solvent and/or a dispersant of the spread coating, evaporates to leave a thin solid coating on the particles. The particles are recirculated to the first zone so that the excess of layers of the coating material may be built up on the core in a uniform manner. After the core has been coated to form material particles, the coating is dried so as to possess the desired triboelectric properties. The drying conditions are readily determined and depend upon the material used for the coating and coating solution.

Typically the size of the toner particles will be from about 1 to 20 microns. The toner may be obtained in any previously determined classified particle size. Also the toner particle size may be measured on a Coulter Counter TA-II. Preferably the toner has a cumulative number distribution of 85% greater than 5 microns, with an average size of approximately 8 microns.

The developer compositions according to the present invention are particularly useful in xerographic copiers wherein the toner is exposed to temperatures in excess of about 100° C. within a fixing zone of the copier. The developer compositions according to the present invention are particularly advantageous when used in Ricoh Copier Model 6400.

The following examples are given by way of illustration and are not intended to limit the scope of the present invention.

EXAMPLE 1

A coated carrier is made from ferrite carrier core having a particle diameter of 100 microns coated with Bakelite® PKHH resin. The toner is prepared from bisphenol A/fumarate polyester (91% by weight) and carbon black (9% by weight). The toner is then admixed with 1% by weight silica and 0.75% by weight zinc stearate. The developer composition is prepared by admixing about 3% of the toner particles by weight with the carrier particles. This developer composition is used to prepare 5,000 copies on a Ricoh FT6400 copier. The coating of PKHH on the carrier was varied from 0.1 to 0.5% by weight. The results of the test are shown in Table 1 where the toner concentration is given in percent by weight of developer and the charge to mass ratio is given microcoulombs. It may be seen from Table 1, that for the lighter coating at relatively stable toner concentrations of developer, Q/M decreases from 17.4 to 13.5 esu at the 5,000 copy interval. For the heavier coating 0.5% by weight, at relatively constant toner concentration, the change to mass ratio is stable.

EXAMPLE 2

The test according to Example 1 above is repeated except that the carrier core is coated with 0.5% by weight of Bakelite® phenoxy PKHJ thermoplastic resin and the toner used is P'-5-1 toner. The developer composition is formed by using 2% by weight of the toner. The core particles are coated with a phenoxy PKHJ resin by solvent coating using methylene chloride as the solvent. The developer composition is used to prepare 20,000 sample copies and the results are shown in Table 2. In Table 2 it is shown that the toner concentration increased during the initial 1,000 copies from 1.90% to about 2.5% and then remained substantially level. The charge to mass ratio changed from about 12.9 microcoulombs to about 11.7 microcoulombs over the 20,000 copies, the course of the test.

TABLE 1

| | PKHH Coating Resin/E' toner | | | |
|---|---|---|---|---|
| Coating Wt % | 0.1 | | 0.5 | |
| Resistivity Ω-cm(1) | $9 \times 10^9$ | | $1.6 \times 10^{12}$ | |
| | Toner Conc(2) | Q/M(3) | Toner Conc(2) | Q/M(3) |
| copy level-start | 3.0 | 17.4 | 3.0 | 16.6 |
| 4,000 | 3.1 | 14.5 | 3.0 | 17.7 |
| 5,000 | 3.2 | 13.5 | 3.1 | 15.8 |

TABLE 2

| | PKHJ Coating Resin/P-5-1 toner | |
|---|---|---|
| Coating Wt % | 0.5 | |
| Resistivity Ω-cm | $1.2 \times 10^{12}$ | |
| | Toner Conc(2) | Q/M(3) |
| copy level-start | 1.9 | 12.9 |
| 1,000 | 2.5 | 13.6 |
| 4,000 | 2.4 | 13.9 |
| 5,000 | 2.4 | 13.0 |

TABLE 2-continued

| PKHJ Coating Resin/P-5-1 toner | | |
|---|---|---|
| Coating Wt % | 0.5 | |
| Resistivity Ω-cm | $1.2 \times 10^{12}$ | |
| | Toner Conc(2) | Q/M(3) |
| 10,000 | 2.6 | 12.1 |
| 15,000 | 2.4 | 13.4 |
| 20,000 | 2.4 | 11.7 |

(1)100 volts
(2)wt %
(3)μc/gm.

What is claimed is:

1. An electrophotographic developer composition comprising coated carrier particles, together with toner particles, the concentration of the toner particles being 1.5–3.5% by weight of the carrier particles, the coating on said carrier particles comprising a thermoplastic copolymer of epichlorohydrin and 2,2-bis-(p-hydroxyphenyl) propane or a hydroxyalkyl ether derivative thereof and said coating comprising from 0.1 to 1% by weight of said carrier particles.

2. An electrophotographic developer composition of claim 1 further comprising a zinc stearate lubricant and silica as a cleaning assist agent.

3. An electrophotographic developer of claim 1 where said toner comprises about 91% by weight of a condensation product of 2,2-bis(4-hydroxyisopropoxyphenyl)-propane and fumaric acid and about 9% by weight carbon black with minor amounts of additives.

4. An electrophotographic developer of claim 1 where said toner comprises about 8.8% by weight of a condensation product of 2,2-bis-(4-hydroxyisopropoxyphenyl)-propane and fumaric acid; about 80% by weight bisphenol A epichlorohydrin epoxy thermoplastic resin and about 11% carbon black and a minor amount of additives.

5. An electrophotographic developer of claim 3 wherein the particle size of the toner is characterized by a cumulative number distribution of 85% greater than 5 microns, with an average size of approximately 8 microns.

6. An electrophotographic developer of claim 4 wherein the particle size of the toner is characterized by a cumulative number distribution of 85% greater than 5 microns, with an average size of approximately 8 microns.

7. A coated carrier for use in electrophotographic developer compositions comprising particles having an iron oxide core having a diameter in the range of about 30 to 1,000 microns coated with a thermoplastic hydroxyalkyl ether of epichlorohydrin and 2,2-bis(p-hydroxyphenyl) propane said thermoplastic hydroxyalkyl ether comprising from 0.1 to 1% by weight of said carrier particles.

8. A carrier according to claim 7 wherein said thermoplastic copolymer has a molecular weight range of 20,000 to 35,000.

9. A carrier according to claim 8 wherein said carrier particles comprise iron ferrite cores having a mean diameter of about 100 microns.

10. In an electrographic process wherein a visible image is produced by depositing toner particles from an electrophotographic developer composition onto a latent electrostatic image, said developer composition comprising coated carrier particles and toner particles, the improvement comprising the step of contacting said latent electrostatic images with a developer composition comprising finely divided toner particles coated on carrier particles wherein said carrier particles have an outer coating consisting of a polymeric material, said material selected from the group consisting of thermoplastic copolymers of epichlorohydrin and 2,2-bis-(p-hydroxyphenyl) propane and hydroxyalkyl derivatives thereof and said coating comprises from 0.1 to 1% by weight of said carrier particles.

* * * * *

UNITED STATES PATENT AND TRADEMARK OFFICE

CERTIFICATE OF CORRECTION

PATENT NO. : 4,468,445

DATED : August 28, 1984

INVENTOR(S) : Paul P. Kelly and Trudy A. Bochantin Connor

It is certified that error appears in the above–identified patent and that said Letters Patent are hereby corrected as shown below:

On the cover page of the patent, left column, after the inventors' names, the following line should be:

--Assignee: Ricoh Company, Ltd., Tokyo, Japan--

Signed and Sealed this

*Twenty-sixth* Day of *February 1985*

[SEAL]

*Attest:*

DONALD J. QUIGG

*Attesting Officer*

*Acting Commissioner of Patents and Trademarks*